US009583082B1

(12) United States Patent
Martin

(10) Patent No.: US 9,583,082 B1
(45) Date of Patent: Feb. 28, 2017

(54) DRUM MOUNT PROVIDING ISOLATED RESONANCE

(71) Applicant: August D. Martin, Albuquerque, NM (US)

(72) Inventor: August D. Martin, Albuquerque, NM (US)

( * ) Notice: Subject to any disclaimer, the term of this patent is extended or adjusted under 35 U.S.C. 154(b) by 0 days.

(21) Appl. No.: 14/821,248

(22) Filed: Aug. 7, 2015

(51) Int. Cl.
*G10D 13/02* (2006.01)

(52) U.S. Cl.
CPC ..... *G10D 13/026* (2013.01)

(58) Field of Classification Search
CPC ..... G10D 13/026; G10G 5/00; G10H 1/32
USPC ..... 84/411 R, 421
See application file for complete search history.

(56) References Cited

U.S. PATENT DOCUMENTS 7,501,567 B1 * 3/2009 Spinazzola ..... G10D 13/023 84/411 R

* cited by examiner

*Primary Examiner* — Kimberly Lockett
(74) *Attorney, Agent, or Firm* — Los Angeles Patent Group; Arman Katiraei

(57) ABSTRACT

Some embodiments provide drum mounts for mounting a drum to supporting bracket arms, stands, or racks in a manner that does not impede drum shell resonance and that shields the drum mount and structure upon which the drum is mounted from absorbing the drum's vibrational energy during play. The drum mount is comprised of an inner mount plate, outer mount bar, and coupling assemblies. Each of the inner mount plate and outer mount bar couple to a drum shell or tension ring using the coupling assemblies. The coupling assemblies also couple the inner mount plate to the outer mount bar. The coupling assemblies include dampeners and endcaps with protrusions for minimizing surface area contact points from which energy can be transferred to the drum mount.

16 Claims, 19 Drawing Sheets

DRUM MOUNT PROVIDING ISOLATED RESONANCE

TECHNICAL FIELD

The present invention pertains to musical instruments and, more specifically, to drum mounts.

BACKGROUND

The drum is a musical instrument that produces sound through resonance of the drum shell. Energy transferred from the drumhead into the drum shell during play creates this resonance and the drum sound. In traditional drum design, drum hoops, lugs, and lug holders couple the drumhead to the drum shell, thereby allowing for the transfer of energy from the drumhead to the drum shell.

Existing drum structures compromise or degrade the drum sound quality by hindering the drum shell resonance. Many factors contribute to this compromised or degraded sound. Some structures position or attach the lug holders directly to the drum shell, thereby impeding the drum shell resonance. Other structures avoid directly impacting the drum shell by coupling the drum hoops at top and bottom ends of the drum shell, but do so in a manner in which some of the energy passing from the drumhead to the drum shell is absorbed into the coupling framework. The framework then rattles or produces other unwanted noises that distort the sound produced from the drum shell resonance. New designs, such as the Ultimount framework set forth in U.S. Pat. Nos. 8,884,144 and 8,629,340, allow the drumhead to be coupled to the drum shell in an isolated way that shields the coupling framework from energy absorption while allowing the drum shell to freely resonate.

The drum mount is another potential source of sound degradation or distortion. Drum mounts attach the drum to a supporting bracket arm, stand, or rack. Existing drum mount structures attach the mount fittings to the drum shell. This then causes the same problems to arise. Once again, the drum shell is prevented from freely resonating. Also, rattling and other unwanted noises may be produced as some of the energy produced during play transfers from the drum shell to the drum mount.

Accordingly, there is a need for a new drum mount that allows the drum shell to resonate freely. There is further a need for such a drum mount to prevent the mount itself from adding to the drum sound. Specifically, there is a need to isolate the drum mount from the energy transferring across other drum structures during play or to at least dampen the transfer of such energy into the drum mount.

BRIEF DESCRIPTION OF THE DRAWINGS

In order to achieve a better understanding of the nature of the present invention a preferred embodiment of the enhanced drum mount, by way of example only, with reference to the accompanying drawings in which.

DETAILED DESCRIPTION OF THE INVENTION

The embodiments presented herein set forth various enhanced drum mounts that do not impede drum shell resonance and that further provide dampening to isolate the drum mount hardware from the drum's sound producing elements and the energy transferring throughout the drum during play. By not impeding the drum shell resonance with the drum mount, the drum produces a richer and fuller sound. Also, by isolating the drum mount hardware from the sound producing drumhead and shell, undesired sounds or distortions from the drum mount are eliminated or minimized.

The drum mount embodiments leverage different structural features to achieve inter-stage isolation and vibration dampening advocated herein. First, the embodiments directly integrate dampeners into the mount-to-drum coupling assembly hardware used to couple the enhanced drum mount of some embodiments to a drum and also in the mount-to-stand coupling assembly hardware used to couple the enhanced drum mount of some embodiments to a supporting arm of drum stand or drum rack. Second, the embodiments introduce specialized endcaps that reduce the surface area contact points over which energy can transfer from the drum to the drum mount and from the drum mount to the drum stand or drum rack. Third, the embodiments split the traditionally manufactured one piece drum mount into two separate pieces comprised of an inner mount plate and an outer mount bar. Specialized endcaps and dampeners are sandwiched in between the mount plate and the mount bar to reduce the contact points over which energy can transfer from the drum and onto the drum mount.

Various embodiments of the enhanced drum mounts couple with or operate in conjunction with existing lugs and lug holders of traditional drum structures. Some other embodiments couple with or operate in conjunction with specialized structural frameworks coupling the drumhead to the drum shell. The Ultimount frameworks described in U.S. Pat. Nos. 8,884,144 and 8,629,340 are examples of some such frameworks. Accordingly, the disclosures from U.S. Pat. Nos. 8,884,144 and 8,629,340 are incorporated herein by reference as reference will be made to various components of the Ultimount frameworks.

Figure 1:
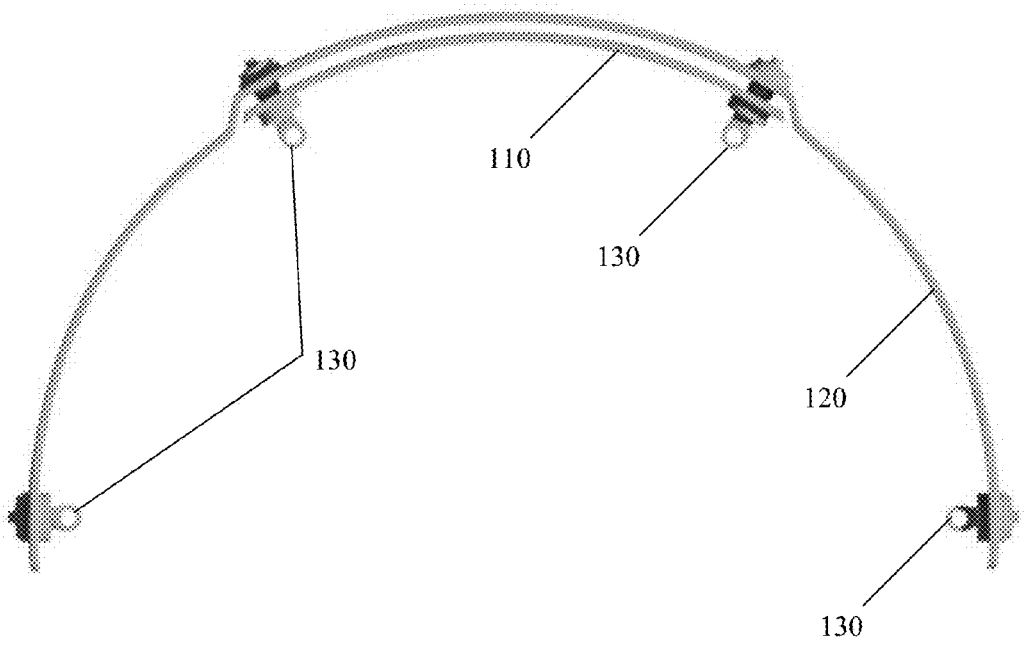
FIG. 1 presents a top view of an enhanced drum mount for coupling to an existing traditional drum using tightening lugs and lug holders in accordance with some embodiments.

FIG. 1 presents a top view of an enhanced drum mount for coupling to an existing traditional drum using tightening lugs and lug holders in accordance with some embodiments. The enhanced drum mount includes an inner mount plate 110, an outer mount bar 120, and four mount-to-drum coupling assemblies 130.

In some embodiments, the radius of the inner mount plate 110 and the outer mount bar 120 closely match the radial circumference of a drum shell or tension ring. This eliminates lateral forces placed on the drum shell when the enhanced drum mount couples the drum to a drum stand, wherein the lateral forces could cause a loss of shell resonance as well as shell warping, distortion, or even splintering of the drum shell.

In FIG. 1, the outer mount bar 120 spans 180 degrees about the outer circumference of the drum shell. Between 60 and 120 degrees, the outer mount bar 120 is offset. This offset section coincides with the size of the inner mount plate 110. The inner mount plate 110 couples to the outer mount bar 120 within the offset section using the mount-to-drum coupling assemblies 130 which further couple the entirety of the enhanced drum mount to the drum. The inner mount plate 110 has a vertical extension (see reference marker 260 of FIG. 2) with one or more apertures to which a supporting arm from a drum stand or drum rack can be coupled using a mount-to-stand coupling assembly of some embodiments. Details of the mount-to-stand coupling assembly are provided with reference to FIGS. 18-20.

Figure 2:
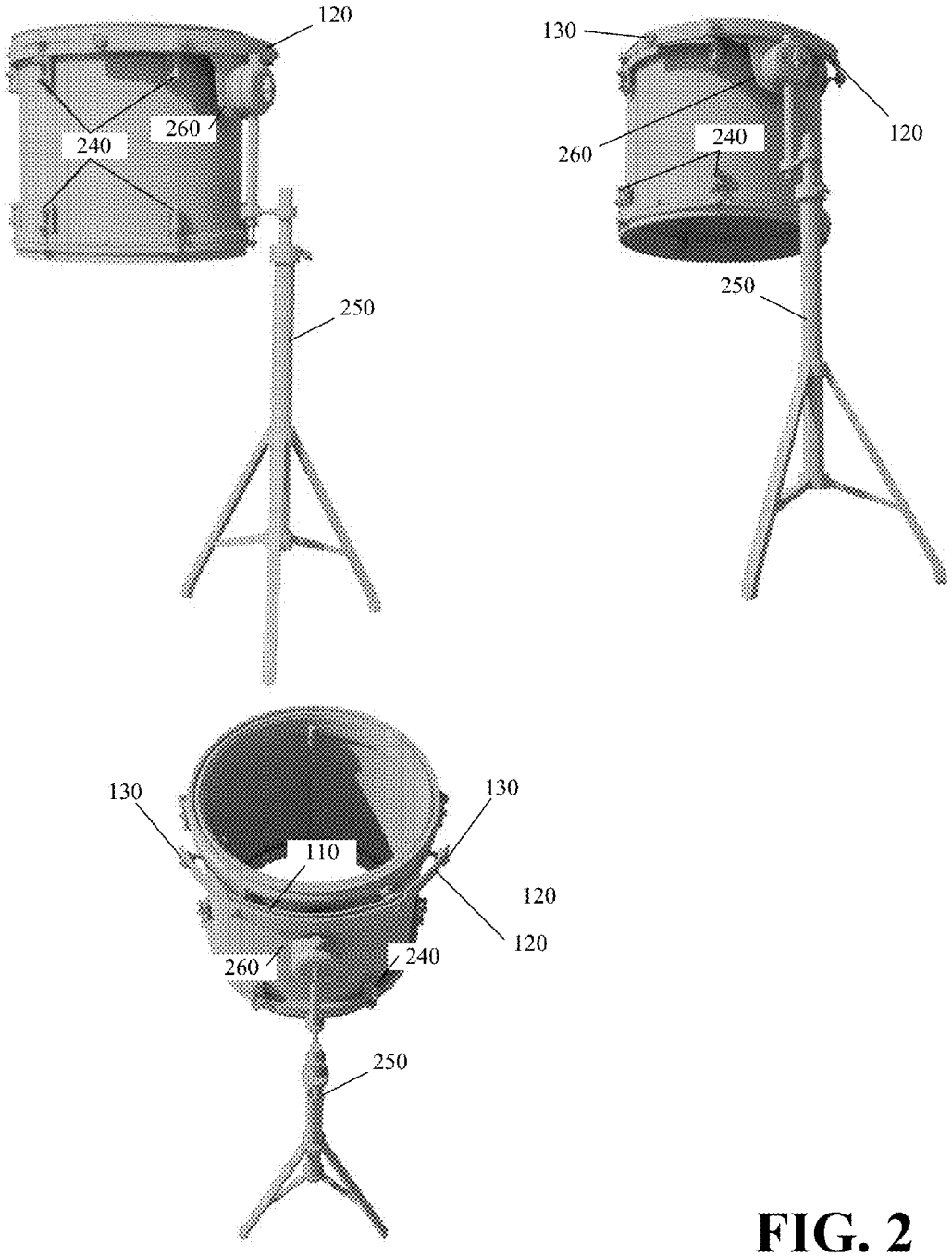
FIG. 2 illustrates the enhanced drum mount of some embodiments mounting a drum to a drum stand.

FIG. 2 illustrates the enhanced drum mount of some embodiments coupling a drum to a drum stand. The enhanced drum mount is first coupled to the lug holders 240 about the drum shell using the mount-to-drum coupling assemblies 130 further described below. Then, using the mount-to-stand coupling assembly, the enhanced drum mount is coupled to a supporting arm of a drum stand or drum rack and the drum is mounted.

In this figure, each of the inner mount plate 110 and the outer mount bar 120 have direct points of contact with the drum shell when mounted to the drum shell lug holders 240. However, only the inner mount plate 110 has direct contact with the stand 250. This specific configuration minimizes the amount of vibrational energy that can transfer onto the stand 250 by way of the inner mount plate 110 as a result of reducing the total number of direct contact points the inner mount plate 110 has with the drum shell. Vibrational energy that transfers from the drum shell onto the outer mount bar 120 is isolated or dampened in the offset section where the inner mount plate 110 couples to the outer mount bar 120.

The mount-to-drum coupling assemblies 130 couple the enhanced drum mount to the drum shell or drum tension ring with dampening and isolation components to shield the inner mount plate 110 and the outer mount bar 120 from the energy transferring across the drumhead, drum hoop, and drum shell during play. With reference back to FIG. 1, the two mount-to-drum coupling assemblies 130 which are 180 degrees apart directly couple the outer mount bar 120 to lug holders that are attached to a traditional rum shell or a tension ring. The other two mount-to-drum coupling assemblies 130 indirectly couple the offset section of the outer mount bar 120 to lug holders attached to a traditional drum shell or tension ring by placing the inner mount plate 110 in between the offset section of the outer mount bar 120 and the mount-to-drum coupling assemblies 130.

The mount-to-drum coupling assemblies 130 have hoops with apertures that align with lug holder positions about the circumference of the drum shell as well as lug extrusions about the circumference of the drum hoop. In FIG. 1 and in preferred embodiments of the enhanced drum mount, the mount-to-drum coupling assemblies and the coupling assembly hoops are positioned at 60 degree offsets about the outer mount bar 120. This not only aligns the mount-to-drum coupling assemblies with the lug holder positions, but also allows suspending the drum with an angle span of 180 degrees which divides the drum's center of gravity. By evenly dividing the drum's center of gravity, many of the mounting forces exerted on the lug holders and the actual drum are removed and the vertical weight of the entire drum is distributed evenly when it is suspended by a supporting bracket arm attached to a drum stand or drum rack using the enhanced drum mount of some embodiments. While the 60 degree offsets are standard, it should be apparent that in some other embodiments, the spacing between the positioning for each of the mount-to-drum coupling assembles can be more or less than 60 degrees.

Figure 3:
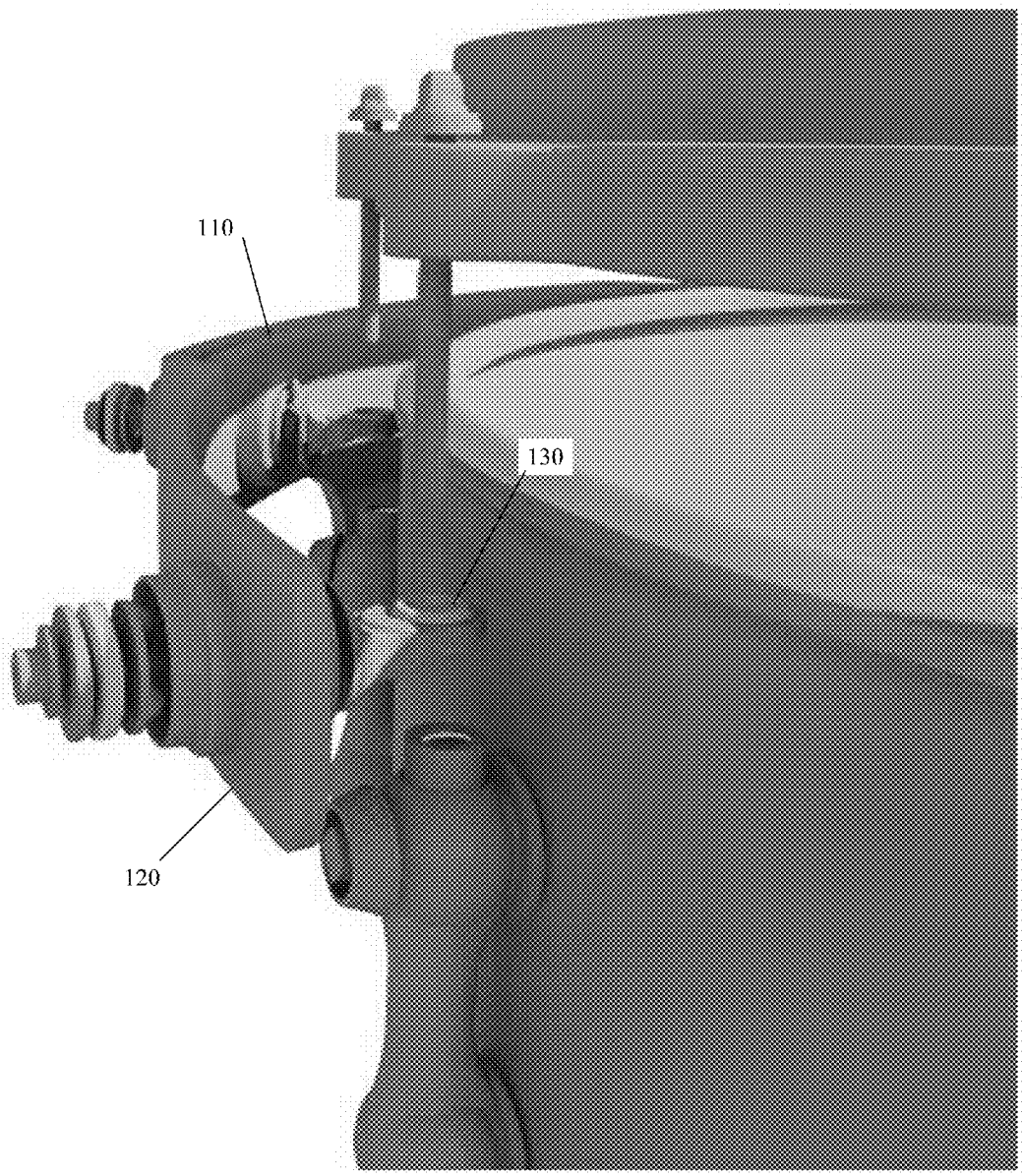
FIG. 3 illustrates coupling the enhanced mount bar of FIG. 1 to a traditional drum using tightening lugs and lug holder positions about a traditional drum.

FIG. 3 illustrates coupling the enhanced mount bar of FIG. 1 to a traditional drum using tightening lugs and lug holder positions about the surface of a traditional drum shell. As shown, the enhanced drum mount coupling assembly hoops are positioned in between lug apertures about a drum hoop and lug holders about the drum shell. The enhanced drum mount is coupled to the drum when the lugs are passed through the lug apertures in the drum hoop and inserted through the coupling assembly hoops and then screwed into the inner threaded swivel nuts inset in the lug holders.

Figure 4:
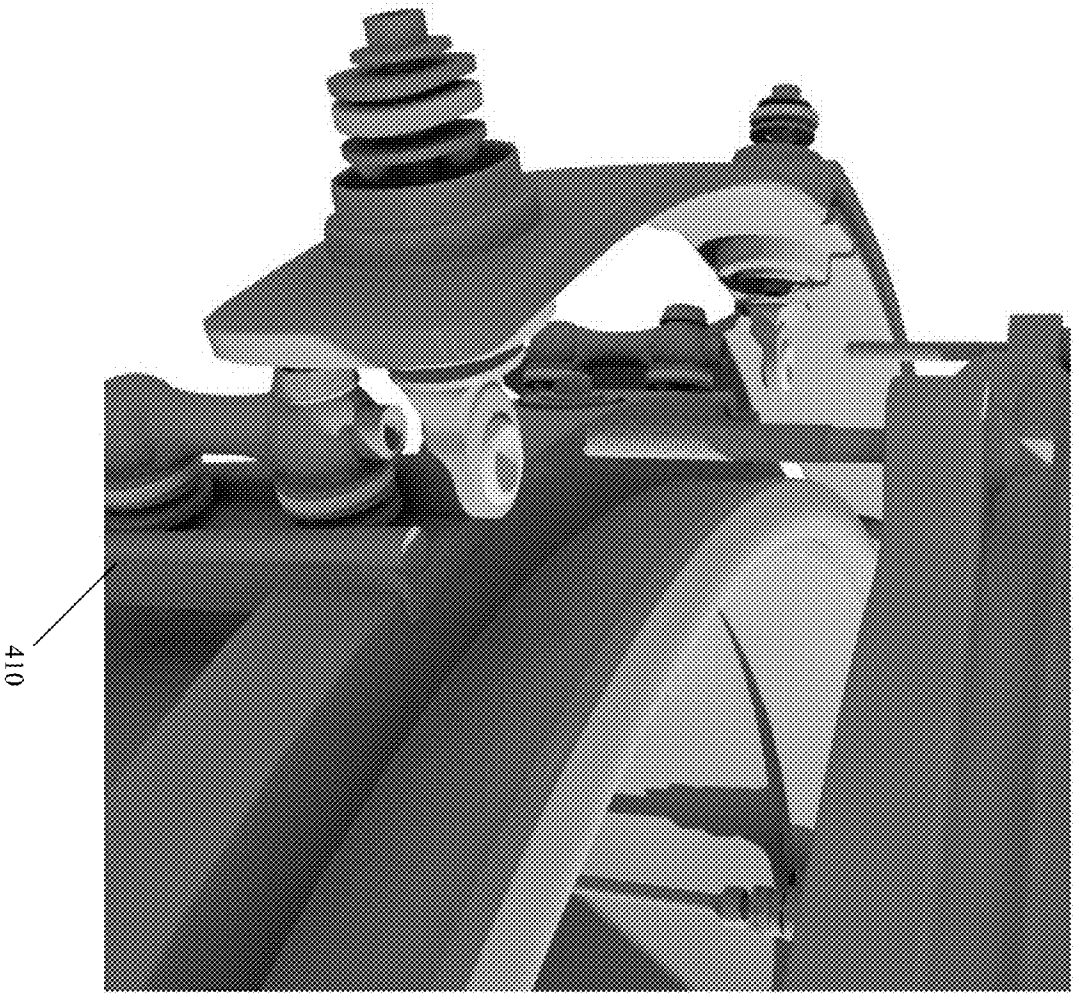
FIG. 4 illustrates how the enhanced mount bar of FIG. 1 can be used with different drum hoops and different lug holder structures.

FIG. 4 illustrates how the enhanced mount bar of FIG. 1 can be used with different drum hoops and different lug holder structures. In FIG. 4, the enhanced mount bar is shown to couple to a tension ring having vertically extending brackets 410 and lug holders that are attached to the vertically extending brackets 410 rather than coupling to a lug holder that is directly attached to a traditional drum shell. This is illustrative of one structural framework that frees the drum shell resonance. As can be seen, the enhanced drum mount is coupled to the drum hoop by horizontally attaching the mount-to-drum coupling assemblies to the mount bar and the mount plate, aligning the hoops of the coupling assemblies over lug holder positions about the tension ring, and passing the tightening lugs through an aperture in the upper drum hoop containing the drumhead, a coupling assembly hoop horizontally coupled to one of the outer mount bar or inner mount plate, and into a lug holder about the tension ring positioned atop the drum shell, wherein tension rods are used to secure the drum shell in between tension rings on either the top or bottom ends of the drum shell.

Figure 5:
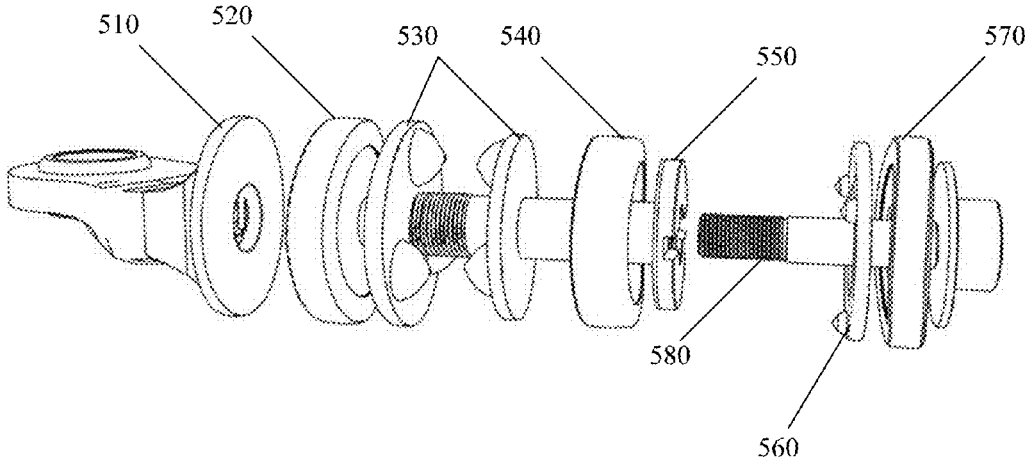
FIG. 5 presents an exploded view for an enhanced drum mount mount-to-drum coupling assembly in accordance with some embodiments.
Figure 6:
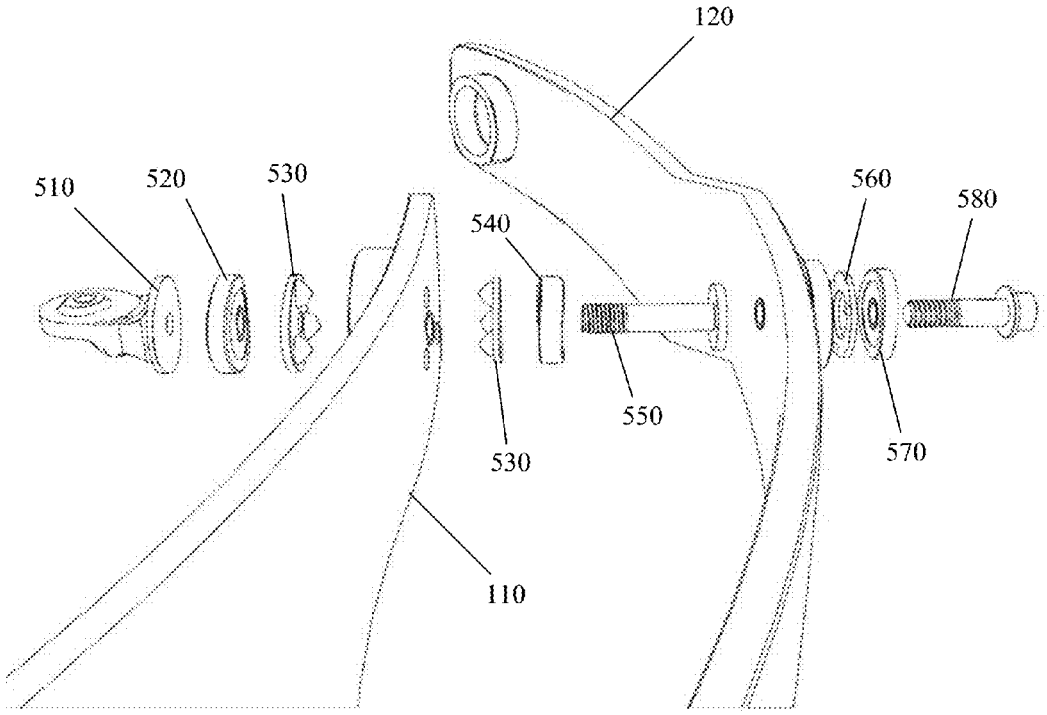
FIG. 6 presents the arrangement of the coupling assembly elements relative to the outer mount bar and the inner mount plate.
Figure 7:
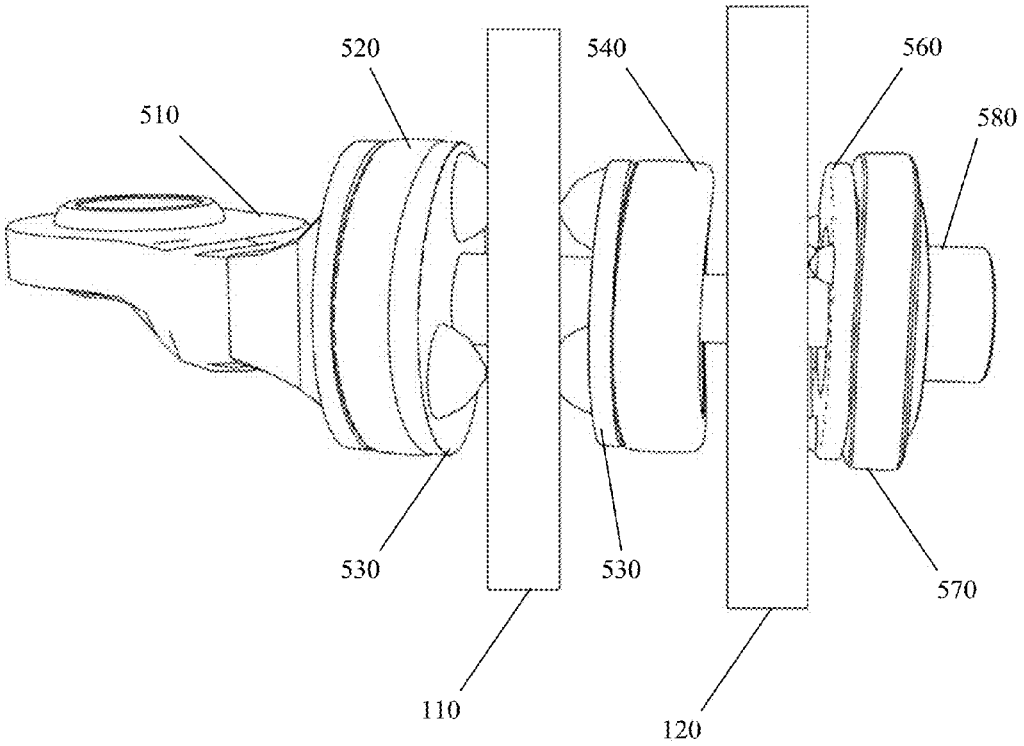
FIG. 7 illustrates a completed mount-to-drum coupling assembly in accordance with some embodiments.

FIG. 5 presents an exploded view for an enhanced drum mount mount-to-drum coupling assembly in accordance with some embodiments. The coupling assembly includes anchor bracket 510, first dampener 520, inner endcaps 530, second dampener 540, inner bolt 550, outer endcap 560, third dampener 570, and outer bolt 580. The mount-to-drum coupling assembly of FIG. 5 couples the offset section of the outer mount bar 120 to the inner mount plate 110 and to a tightening lug which is screwed into a lug holder. The arrangement of the coupling assembly elements relative to the outer mount bar 120 and the inner mount plate 110 is presented in FIG. 6. FIG. 7 illustrates a completed mount-to-drum coupling assembly in accordance with some embodiments.

The anchor bracket 510 has a vertically oriented hoop and a lateral face with an inner threaded cavity at its center. The hoop is aligned with a lug holder opening such that a tightening lug can be used to secure the anchor bracket 510 to the lug holder. Specifically, the drum hoop lug aperture is positioned atop the lug holder inner threaded swivel nut opening and is held in place when the tightening lug is passed through the lug aperture in the drum hoop and further inserted through the anchor bracket 510 hoop and then screwed into the inner threaded swivel nut inset in the lug holder.

The first dampener 520 is positioned to abut the anchor bracket 510 lateral face and provide a first level of vibration dampening and absorption for any energy that passes from the drum hoop or drum shell onto the tightening lug that is screwed into a swivel nut inset in a lug holder and onto the coupling assembly by virtue of the coupling assembly being coupled to the tightening lug and the lug holder. The backside of one of the inner endcaps 530 is positioned against the first dampener 520 with the inner endcap protrusions contacting the inner mount plate 110. In some embodiments, the inner endcap protrusions fit within recesses stamped into the inner mount plate 110. The protrusions provide a second level of dampening. The protrusions minimize the amount of surface area contact that the mount-to-drum coupling assembly has with the inner mount plate 110. This in turn minimizes the amount of vibration energy that can transfer from the mount-to-drum coupling assembly onto the inner mount plate 110. Thus any energy that is transferred from the drumhead or drum shell onto the lug holder and past the first dampener 520 is further attenuated by the reduced points of contact that each of the inner endcaps 530 have with the inner mount plate 110.

The second dampener 540 abuts the backside of the second of the inner endcaps 530. The second dampener 540 is positioned between the inner mount plate 110 and the offset section of the outer mount bar 120. The second dampener 540 provides a third level of dampening and absorption for any energy that transfers onto the inner mount plate 110 from the drumhead or drum shell.

The inner bolt 550 comprises outer threading at one end and an enlarged top at the other end which contains an inner threaded central cavity similar to the one about the anchor bracket 510 lateral face. The inner bolt 550 holds and couples together the anchor bracket 510, first dampener 520, inner endcaps 530, and second dampener 540. The inner bolt 550 does so with the outer threaded end passing through central openings about each of the second dampener 540, inner endcaps 530, inner mount plate 110, and first dampener 520. The inner bolt 550 outer threaded end screws into the inner threaded cavity about the anchor bracket 510 lateral face, securing the position of and further compressing the first dampener 520, inner endcaps 530, inner mount plate 110, and second dampener 540 in between the anchor bracket 510 lateral face and the inner bolt 550 enlarged top. The other side of the inner bolt 550 enlarged top is positioned to abut the offset section of the outer mount bar 120. Specifically, an opening about the offset section is aligned with the inner bolt 550 inner threaded cavity.

The outer endcap 560 is positioned on the outer side of the outer mount bar 120 offset section with the protrusions abutting the outer mount bar 120. In some embodiments, the outer mount bar 120 contains recesses into which the outer endcap 560 protrusion fit. The third dampener 570 abuts the flat side of the outer endcap 560. Here again, additional dampening is provided by the outer endcap 560 protrusions and the third dampener 570 to reduce or eliminate energy from transferring to the outer mount bar 120.

Figure 8:
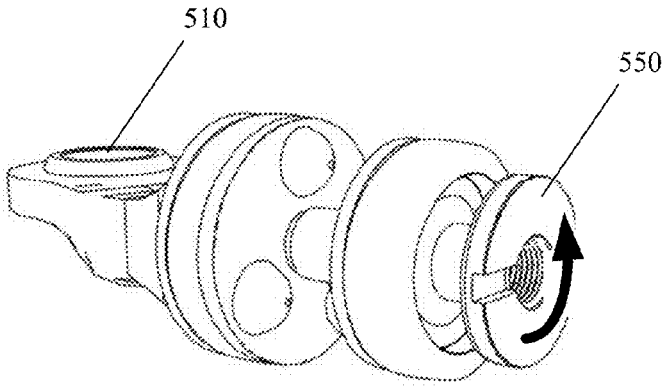
FIG. 8 illustrates the inner bolt screwing into the anchor bracket.
Figure 9:
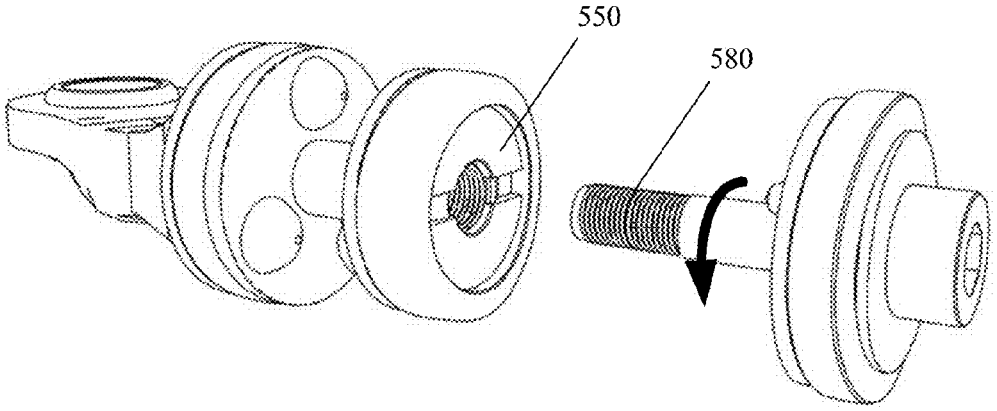
FIG. 9 illustrates the outer bolt screwing into the inner bolt in accordance with some embodiments.

The outer bolt 580 holds and couples together the third dampener 570, outer endcap 560, and outer mount bar 120 to the rest of the coupling assembly. The outer bolt 580 includes outer threading at one end and an enlarged top at the other end. The outer threaded end of the outer bolt 580 passes through central openings about each of the third dampener 570, inner endcap 560, and outer mount bar 120. The outer bolt 580 outer threaded end screws into the inner threaded cavity about the inner bolt 550 enlarged top, thereby securing the position of and compressing the third dampener 570, outer endcap 560, and outer mount bar against the enlarged top of the inner bolt 550 which also couples the rest of the assembly to the lug holder. FIG. 8 illustrates the inner bolt 550 screwing into the anchor bracket 510 and FIG. 9 illustrates the outer bolt 580 screwing into the inner bolt 550 in accordance with some embodiments.

A more simple mount-to-drum coupling assembly is used in coupling a non-offset section of the outer mount bar 120 directly to a lug holder without the inner mount plate 110 in between. In some such embodiments, the more simple mount-to-drum coupling assembly omits the outer endcap 560 and third dampener 570.

FIGS. 1-9 have thus far illustrated coupling the enhanced drum mount of some embodiments using tightening lugs and traditional lug holders. However, the enhanced drum mounts can be adapted for use with other drum structures that depart from traditional drum designs. Some different structures with which the enhanced drum mounts of some embodiments can be used include the Ultimount structural frameworks set forth in U.S. Pat. Nos. 8,884,144 and 8,629,340. As noted above, the disclosures from U.S. Pat. Nos. 8,884,144 and 8,629,340 are incorporated herein by reference.

The Ultimount frameworks include anchors that are coupled to the top and bottom drum hoops with various energy dampening components isolating the Ultimount framework from the energy transferring from the drumhead to the drum shell. Tension rods span the full height of the drum shell and couple to anchors attached to the top and bottom hoops. The tension rods can be used to set an amount of compression that is exerted by the top and bottom hoops on the drum shell in between and, more importantly, to securely couple the drum hoops to the drum shell without impeding the drum shell resonance.

Figure 10:
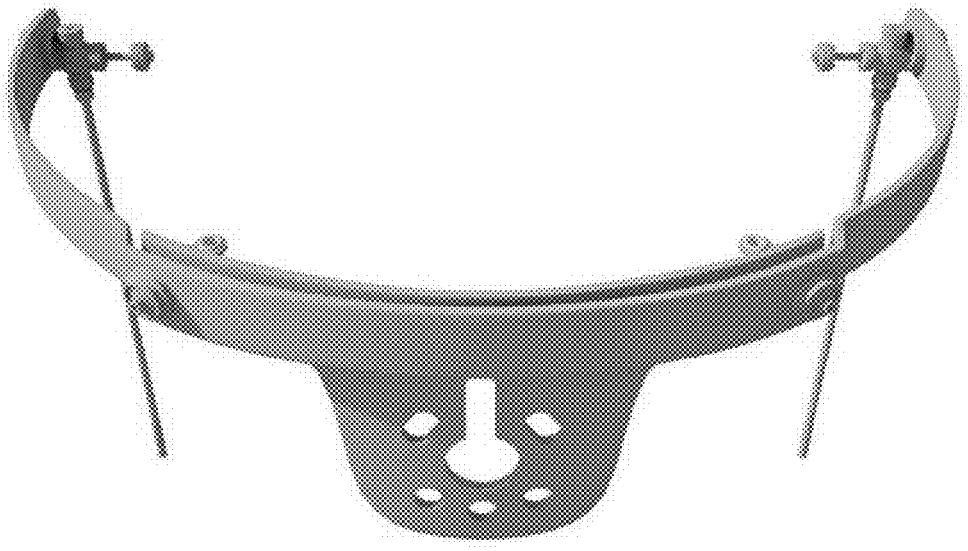
FIG. 10 illustrates coupling the enhanced drum mount to the Ultimount anchors in accordance with some embodiments.
Figure 11:
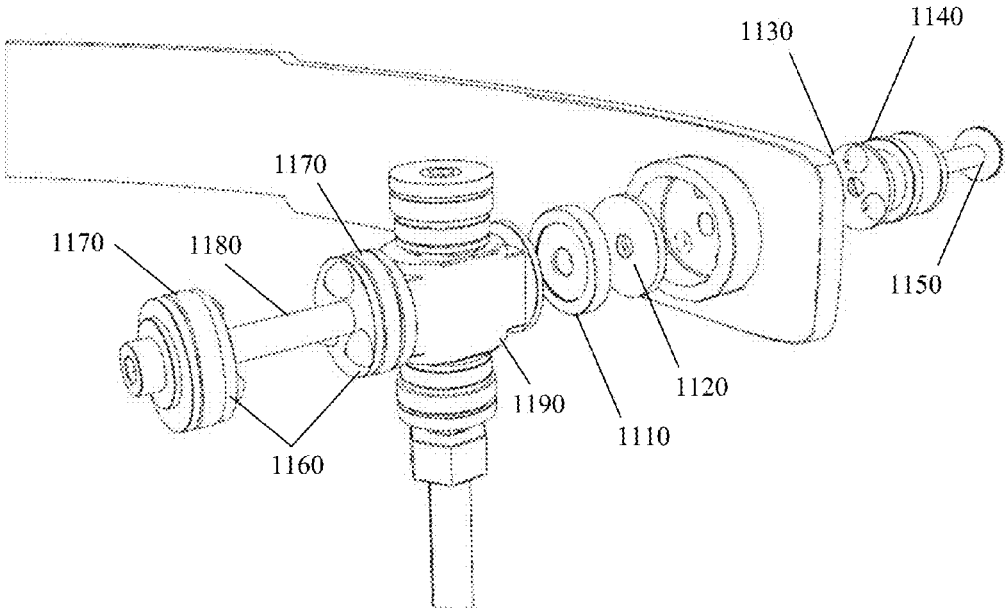
FIG. 11 provides an exploded view illustrating the mount-to-drum coupling assembly used in coupling the enhanced drum mount to the Ultimount anchors in accordance with some embodiments.

FIG. 10 illustrates coupling the enhanced drum mount to the Ultimount anchors in accordance with some embodiments. FIG. 11 provides an exploded view illustrating the mount-to-drum coupling assembly used in coupling the enhanced drum mount to the Ultimount anchors in accordance with some embodiments. The mount-to-drum coupling assembly includes intermediary dampener 1110, intermediary endcap 1120, outer endcap 1130, outer dampener 1140, and outer bolt 1150 to compliment the Ultimount coupling assembly comprising inner endcaps 1160, inner dampeners 1170, inner bolt 1180, and anchor 1190.

A brief overview of the Ultimount coupling assembly is provided for reference and to better illustrate how the enhanced drum mount of some embodiments and its coupling assembly compliments the various energy isolation and dampening features of the Ultimount framework. The Ultimount pronged inner endcaps 1160 are positioned on either side of a lateral opening about a side of an Ultimount tension ring. The inner dampeners 1170 are positioned about the flat backside of the prongs on the inner endcaps 1160. Collectively, the reduced surface contact made between the prongs of the inner endcaps 1160 and the complimentary recesses about the inner and outer faces of the tension ring along with the inner dampeners 1170 provide a first level of vibration dampening to mitigate energy transferring onto the Ultimount framework. The inner bolt 1180 has an enlarged top at one end and outer threading at the other end and is used to couple the inner dampeners 1170, the inner endcaps 1160, and tension ring to the Ultimount anchor 1190. In this configuration, the Ultimount anchor 1190 is secured along the outside of the tension ring. However, in alternative configurations, the Ultimount anchor 1190 can be secured along the inside of the tension ring. Further detail of the Ultimount coupling components and coupling is provided in U.S. Pat. Nos. 8,884,144 and 8,629,340.

The mount-to-drum coupling assembly of FIG. 11 is used to couple the enhanced drum mount of some embodiments to the Ultimount anchor 1190. To do so, the intermediary dampener 1110 is positioned between the anchor 1190 and the flat backside of the intermediary endcap 1120. The intermediary endcap 1120 prongs fit within complimentary recesses about the inner face of the outer mount bar. The reduced surface contact with the outer mount bar provided by the intermediary endcap 1120 prongs as well as the intermediary dampener 1110 provide a second level of dampening for energy that transferred from the outer mount bar through to the Ultimount anchor or from the tension ring to the Ultimount anchor. These intermediary components 1110 and 1120 mitigate the energy from further propagation through either the enhanced drum mount or the Ultimount framework.

Figure 12:
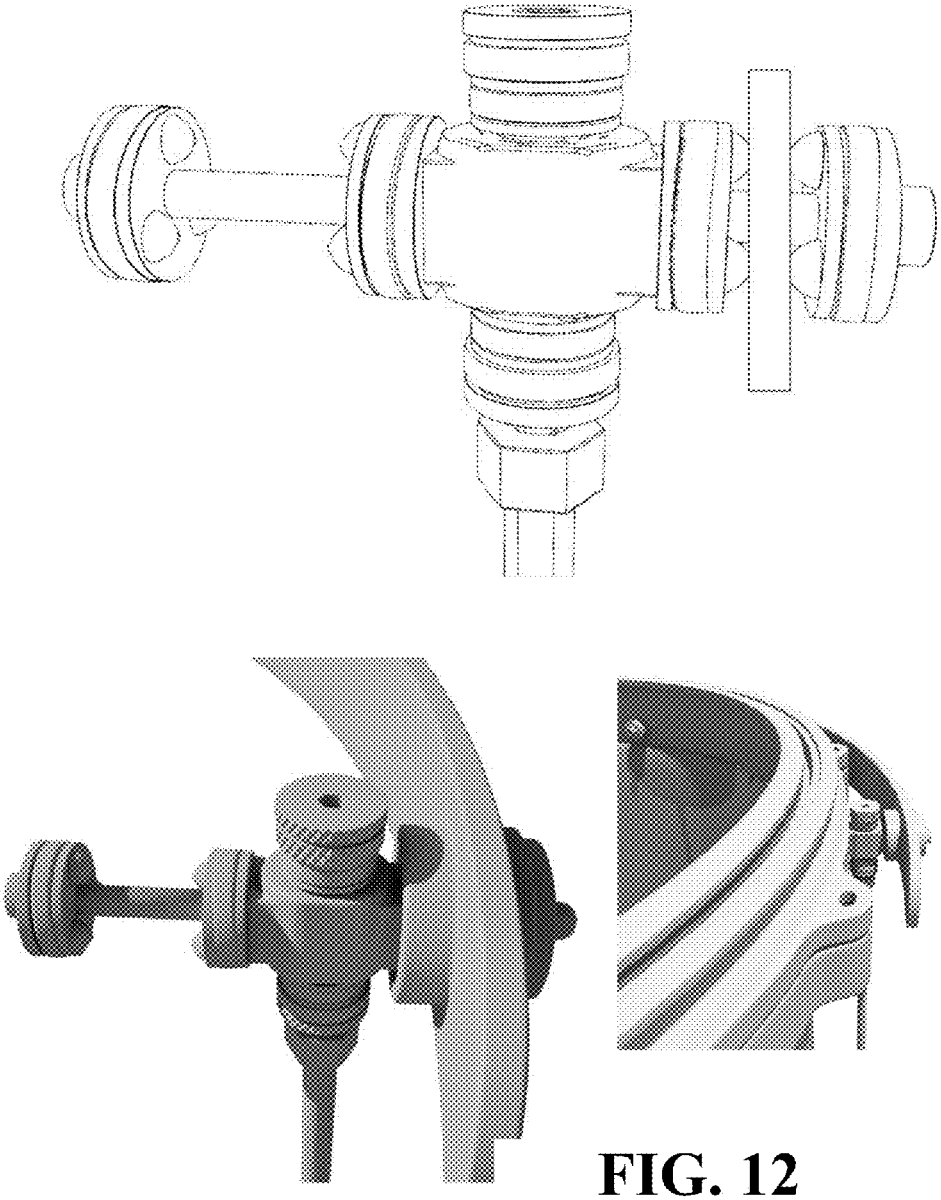
FIG. 12 provides different illustrations for a completed mount-to-drum coupling assembly coupling the outer mount bar of the enhanced drum mount to the Ultimount anchor in accordance with some embodiments.

The prongs of the outer endcap 1130 abut the outer face of the outer mount bar, once again providing dampening by reducing the surface contact between the mount-to-drum coupling assembly and the outer mount bar. The outer dampener 1140 is positioned against the flat back side of the outer endcap 1130. Together the outer endcap 1130 and the outer dampener 1140 provide a third level of dampening to mitigate against energy from the tension ring transferring onto the outer mount bar. The outer bolt 1150 includes an enlarged top at one end and outer threads at the other end. The threaded end is passed through central openings of the outer dampener 1140, the outer endcap 1130, through the outer mount bar opening, through central openings of the intermediary endcap 1120, and the intermediary dampener 1110 before screwing into another inner threaded cavity of the Ultimount anchor 1190. Whereas the inner bolt 1180 of the Ultimount coupling assembly is used to secure the tension ring and inner dampening components to the Ultimount anchor 1190, the outer bolt 1150 is used to secure the outer mount bar, outer dampening components 1130 and 1140, and intermediary dampening components 1110 and 1120 to the Ultimount anchor 1190. FIG. 12 provides different illustrations for a completed mount-to-drum coupling assembly coupling the outer mount bar of the enhanced drum mount to the Ultimount anchor in accordance with some embodiments.

Figure 13:
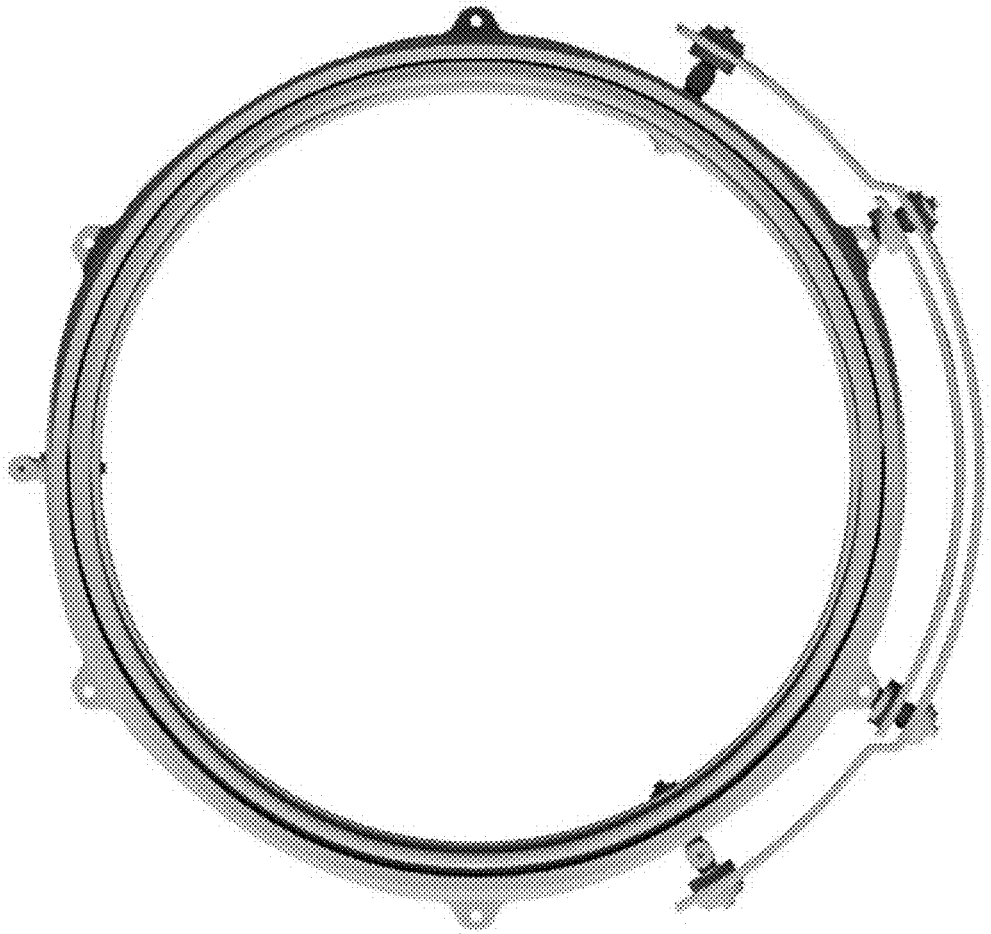
FIG. 13 illustrates the outer mount bar of the enhanced drum mount coupling to the Ultimount tension ring with the inner mount plate of the enhanced drum mount coupling to the lug holder extrusions about the tension ring circumference.

It should be noted that the Ultimount framework can be applied to drum hoops having traditional lug holder extrusions. In such cases, the enhanced drum mount can be adapted to couple to both the Ultimount anchors using the mount-to-drum coupling assembly of FIG. 11 and the lug holder extrusions using the mount-to-drum coupling assembly of FIG. 5. FIG. 13 illustrates the outer mount bar of the enhanced drum mount coupling to the Ultimount tension ring with the inner mount plate of the enhanced drum mount coupling to the lug holder extrusions about the tension ring circumference.

Figure 14:
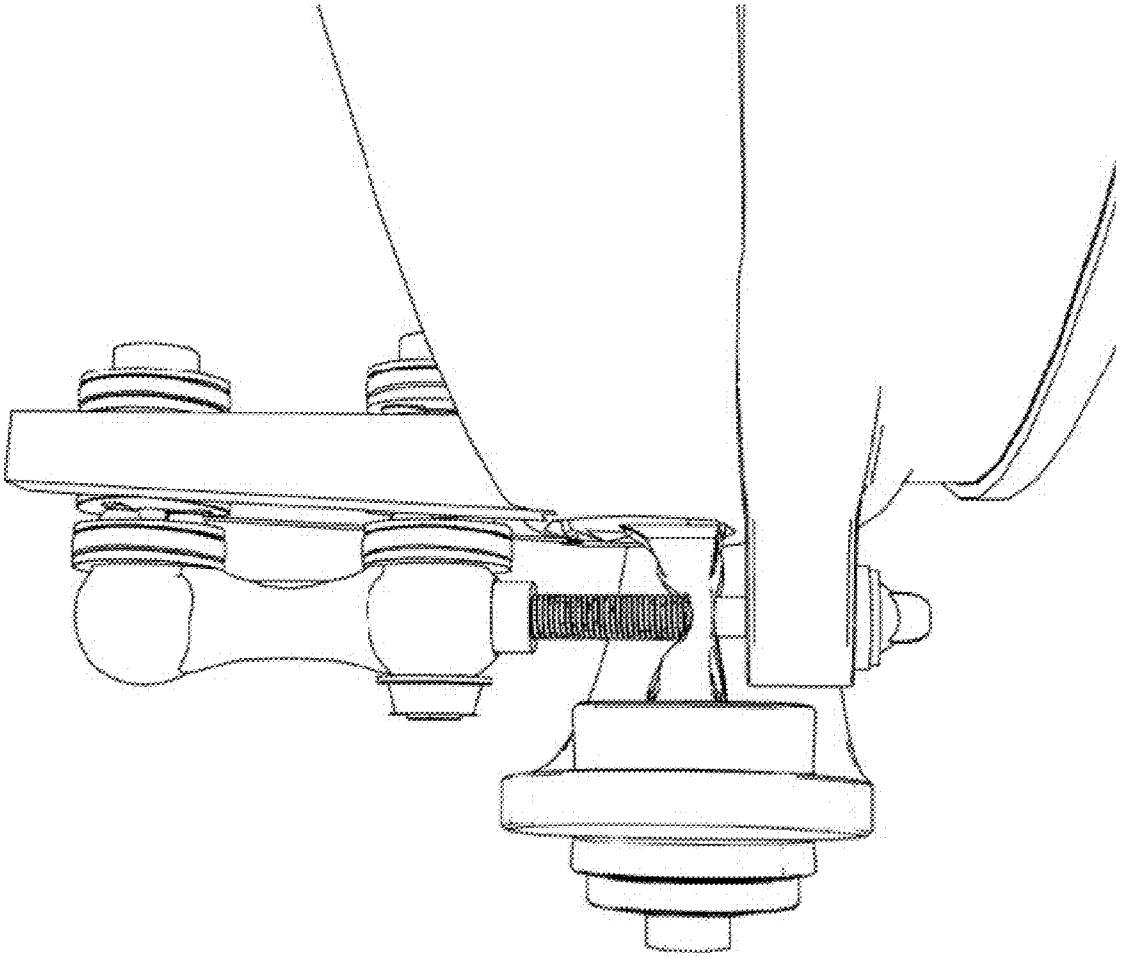
FIG. 14 illustrates one adaptation of the enhanced drum mount in accordance with some embodiments.

In some embodiments, the enhanced drum mount outer mount bar and inner mount plate can be adapted to couple to other frameworks that are aligned with and make use of the existing lug holder extrusions about the drum hoop exterior. FIG. 14 illustrates one such adaptation of the enhanced drum mount in accordance with some embodiments. In this figure, the mount-to-drum coupling assembly is modified to include a metal spacer placed at the lug holder position. This mount-to-drum coupling assembly can be used when the Ultimount anchors are aligned to coincide with lug holder positions about the drum hoop.

Figure 15:
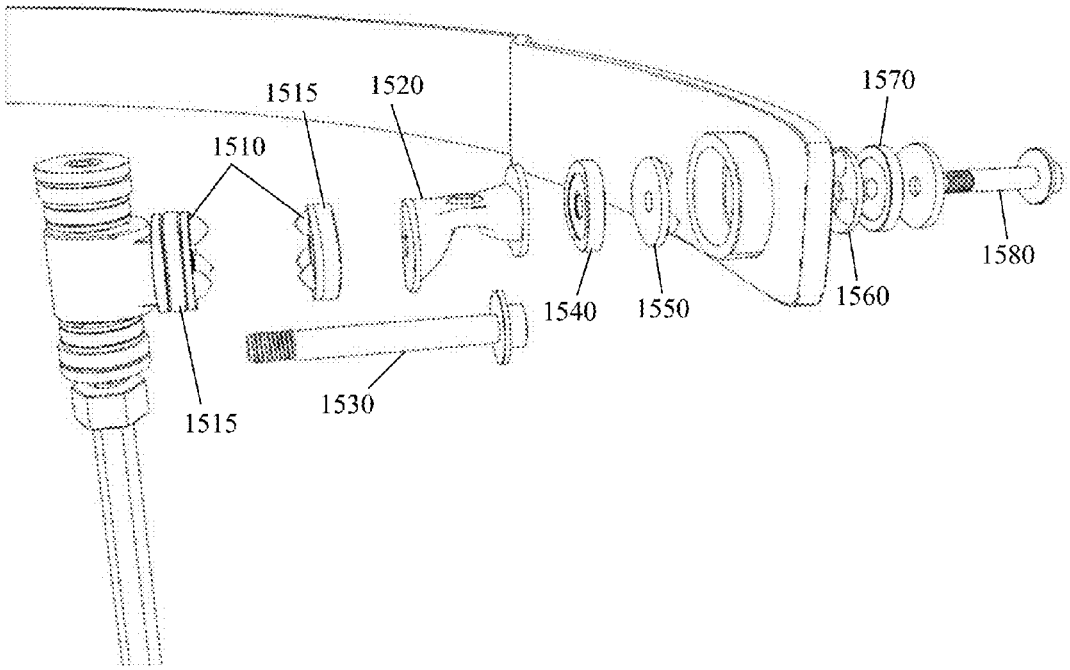
FIG. 15 provides an exploded view for the mount-to-drum coupling assembly of the enhanced drum mount used in conjunction with the Ultimount framework when the Ultimount anchors are aligned with the lug holder positions.

FIG. 15 provides an exploded view for the mount-to-drum coupling assembly of the enhanced drum mount used in conjunction with the Ultimount framework when the Ultimount anchors are aligned to coincide with the lug holder positions. The mount-to-drum coupling assembly includes inner endcaps 1510, dampeners 1515, metal spacer 1520, inner bolt 1530, intermediary dampener 1540, intermediary endcap 1550, outer endcap 1560, outer dampener 1570, and outer bolt 1580.

In FIG. 15, the Ultimount anchor is secured in the interior of the tension ring with the vertical tension rod extending within the drum shell to a second Ultimount anchor secured to the interior of the opposite tension ring. Inner endcaps 1510 and dampeners 1515 are positioned on either sides of the tension ring. Abutting the inner dampener about the exterior of the tension ring is the metal spacer 1520 from the enhanced drum mount coupling assembly. The inner endcaps 1510 and dampeners 1515 mitigate energy transfer from the tension ring to the Ultimount anchor on one side and the outer mount bar on the other side (or the inner mount plate).

Figure 16:
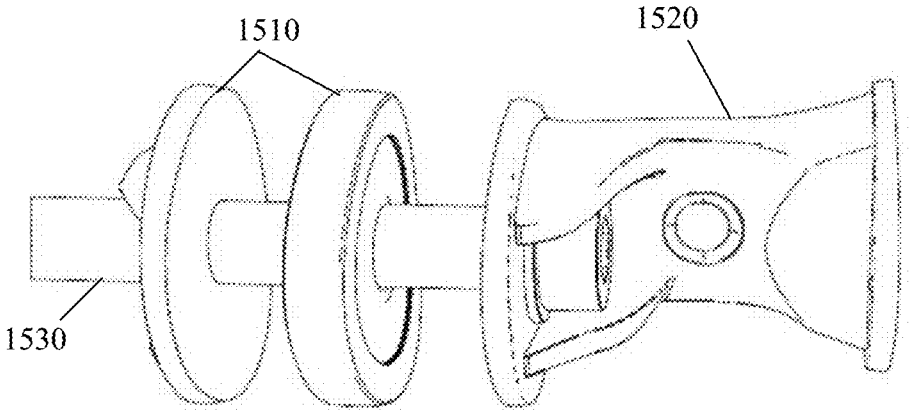
FIG. 16 provides a bottom view of the metal spacer and further illustrates how the metal spacer couples to the Ultimount coupling assembly in accordance with some embodiments.

FIG. 16 provides a bottom view of the metal spacer 1520 and further illustrates how the metal spacer 1520 couples to the Ultimount coupling assembly. The metal spacer 1520 has a non-threaded central vertical opening as well as vertical extensions from either end. These consist of a non-threaded horizontal opening facing towards the outside of the tension ring and an inner-threaded cavity facing toward the inner facet of the outer mount bar. An inner bolt 1530 passes through the non-threaded horizontal opening of the metal spacer 1520 facing towards the outside facet of the tension ring and through central openings of the inner endcaps 1510 and dampeners 1515 with the tension ring in between. The enlarged top of the inner bolt 1530 is braced against the inward facing vertical extension with the horizontal opening through which the inner bolt 1530 passes. The inner bolt 1530 outer threaded end screws into the inner threaded Ultimount anchor, thereby securing the Ultimount anchor to the inward side of the tension ring.

With reference back to FIG. 15, the intermediary dampener 1540 and intermediary endcap 1550 are positioned between the outward facing vertical extension of the metal spacer 1520 and the complimentary recesses about the inner face of outer mount bar, such that the metal spacer 1520 vertical opening is directly aligned over a lug holder threaded opening. Different embodiments may provide metal spacers of different lengths in order to ensure the positioning of the metal spacer vertical opening over a corresponding lug holder threaded opening. A tightening lug passing through the non-threaded central vertical opening of the metal spacer 1520 screws into the aligned lug holder threaded opening. The tightening lug couples the mount-to-drum coupling assembly to the lug holder and the tension ring is then secured with the tightening lug and lug holder as shown in FIG. 14.

Figure 17:
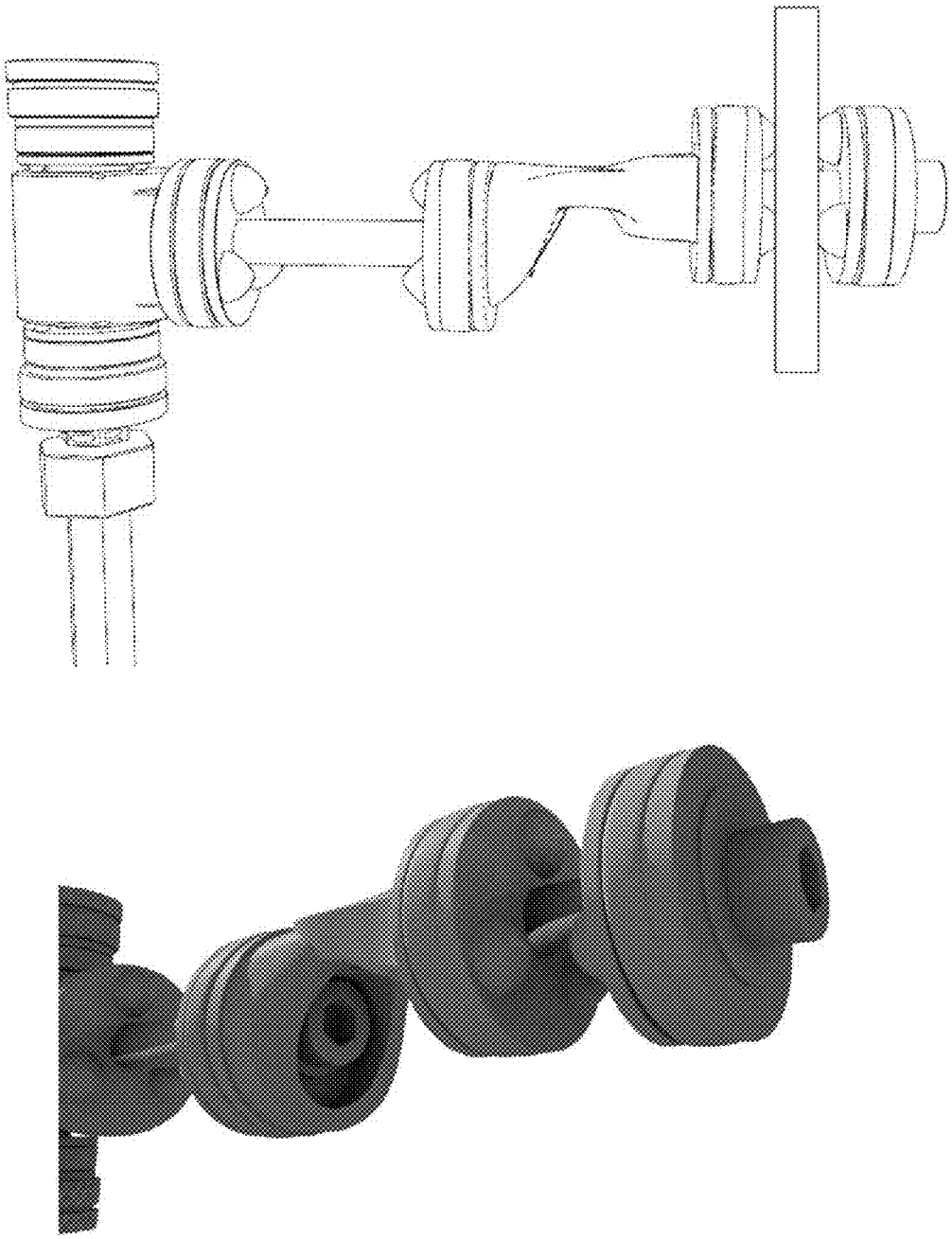
FIG. 17 provides two illustrations for the completed enhanced drum mount coupling assembly with the metal spacer in accordance with some embodiments.

Outer dampener 1570 and outer endcap 1560 are then positioned to couple to the complimentary recesses placed on the outer mount bar outer face. The outer bolt 1580 then passes through central openings of each of the outer dampener 1570, outer endcap 1560, outer mount bar, intermediary endcap 1550, intermediary dampener 1540 before screwing into an inner threaded cavity about the outer facing vertical extension of the metal spacer 1520. FIG. 17 provides two illustrations for the completed enhanced drum mount coupling assembly with the metal spacer in accordance with some embodiments.

Thus far, the enhanced drum mount dampening and isolation elements have been presented relative to the mount-to-drum coupling assemblies that are used in coupling the enhanced drum mount to the drum. In these embodiments, the dampening and isolation elements reduce and restrict the amount of vibration energy that transfers from the drum to the enhanced drum mount during play.

Some embodiments include additional dampening and isolation elements in the mount-to-stand coupling assembly. The mount-to-stand coupling assembly couples the enhanced drum mount to a drum stand or drum rack. More specifically, the mount-to-stand coupling assembly couples the enhanced drum mount inner mount plate vertical extension to a supporting arm of a drum stand or drum rack with integrated dampening elements shielding energy transfer from the enhanced drum mount to the supporting arm of the drum stand or drum rack.

These embodiments provide an additional buffer to limit or prevent vibration energy from transferring onto the drum stand or drum rack. Specifically, any energy that transfers through the mount-to-drum dampening and isolation elements to the enhanced drum mount must also pass through the second layer of dampening and isolation elements integrated into the mount-to-stand coupling assembly before transferring onto the supporting arm of the drum stand or drum rack. The combined dampening and isolation effectively eliminates the potential of energy transfer from the drum to the drum stand or drum rack, thereby reducing any undesired rattling, noise, or movement during drum play.

Figure 18:
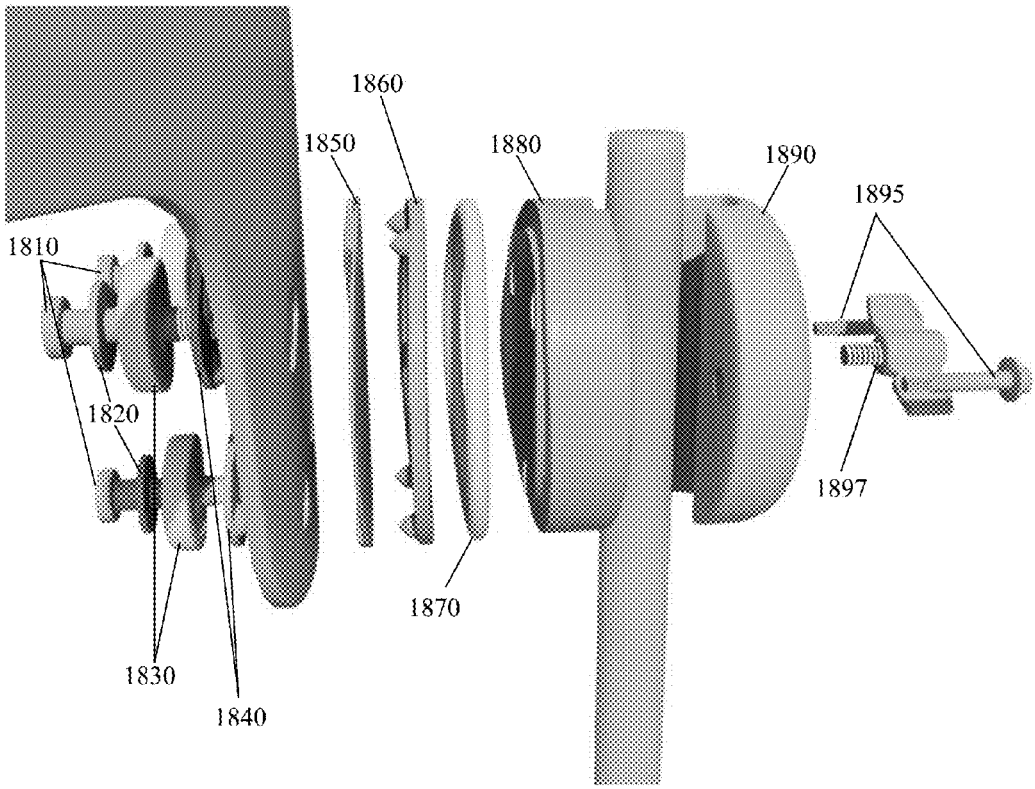
FIG. 18 provides an exploded view presenting the mount-to-stand coupling assembly and the integrated dampening and isolation elements thereof in accordance with some embodiments.
Figure 19:
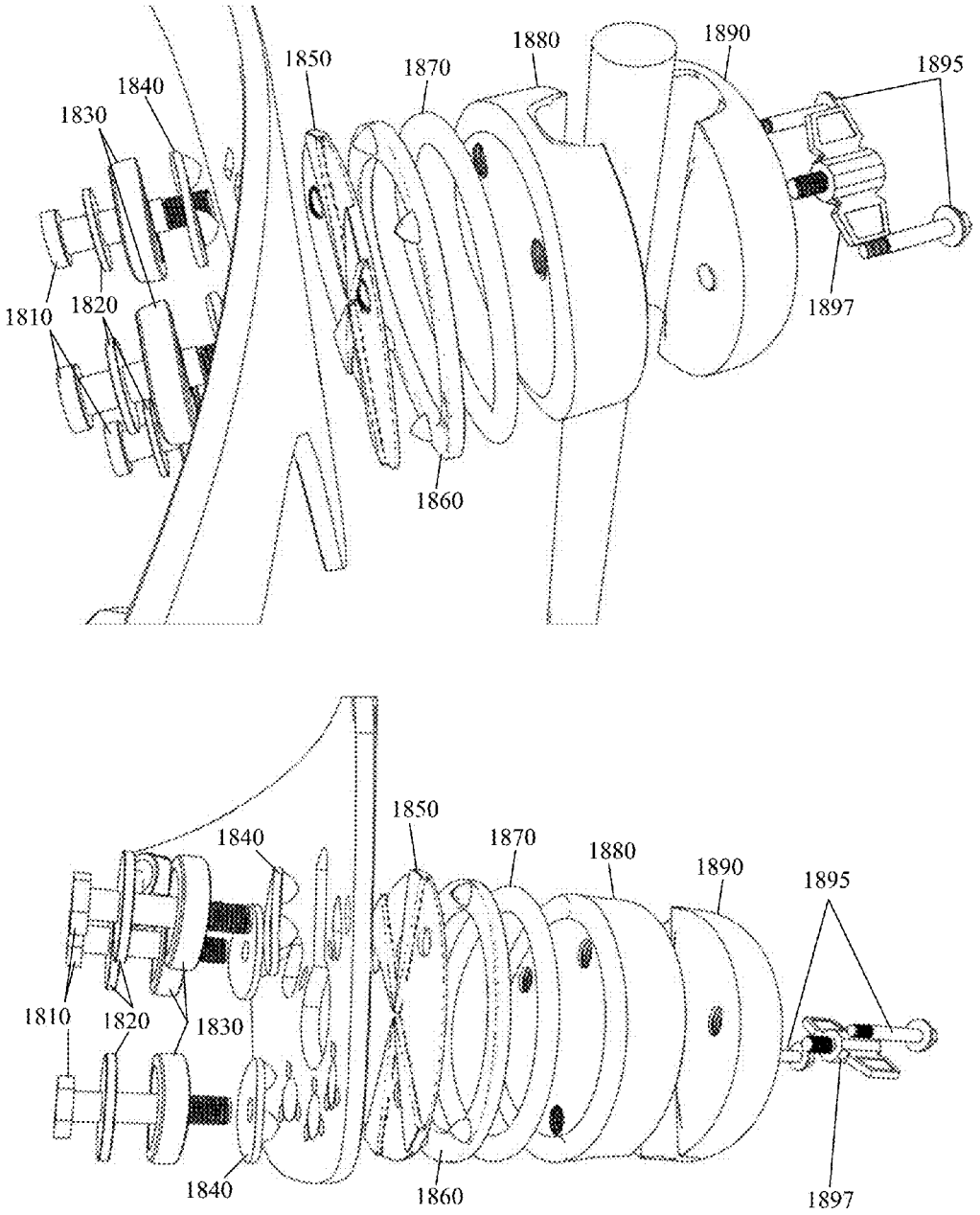
FIG. 19 provides different perspective views for the mount-to-stand assembly elements of some embodiments.

FIG. 18 provides an exploded view presenting the mount-to-stand coupling assembly and the integrated dampening and isolation elements thereof in accordance with some embodiments. FIG. 19 provides different perspective views for the mount-to-stand assembly elements of some embodiments.

The mount-to-stand assembly includes a set of bolts 1810, washers 1820, dampeners 1830, gripped endcaps 1840, spacer 1850, gripped o-ring 1860, o-ring dampener 1870, set of screws 1895, wing nut 1897, and mounting bracket having a front plate 1880 and a back plate 1890.

The bolts 1810, washers 1820, dampeners 1830, gripped endcaps 1840, spacer 1850, gripped o-ring 1860, o-ring dampener 1870, and front plate 1880 couple to the inner mount plate vertical extension. The prongs of the gripped endcaps 1840 rest in recessed guides that are placed around each aperture on the inner facet of the inner mount plate vertical extension. The set of bolts 1810 secure the washers 1820, dampeners 1830, and gripped endcaps 1840 about the inner face of the inner mount plate vertical extension and the spacer 1850, gripped o-ring 1860, o-ring dampener 1870, and front plate 1880 about the outer face of the inner mount plate by passing through a hole pattern of the inner mount plate vertical extension and screwing into a complimentary set of inner threaded holes about the front plate 1880. Different embodiments provide different hole patterns or multiple hole patterns about the inner mount plate vertical extension for universal application.

As before, the gripped endcaps 1840 and the gripped o-ring 1860 minimize surface area contact that the mount-to-stand assembly has with the enhanced drum mount inner mount plate. The reduced amount of surface area contact provides a first level of energy dampening and isolation as it minimizes the amount of energy that can transfer from the inner mount plate to the mount-to-stand assembly, the supporting bracket arm, and ultimately to the drum stand itself.

The dampeners 1830 and o-ring dampener 1870 provide a second level of energy dampening and isolation by attenuating any vibration energy that is transferred onto the endcaps 1840 and gripped o-ring 1860. The dampeners 1830 and 1870 are composed of one or more vibration energy absorbing materials. The dampeners 830 and 1870 and other dampeners described herein can be manufactured from natural or synthetic rubbers, such as isobutylene-isoprene, ethylene propylene diene monomer, and polyacrylic, or from other materials such as silicone.

The front plate 1880 contains a groove to fit on one side of the supporting arm of the drum stand or drum rack with a complimentary back plate 1890 having a complimentary groove fitting on the other side of the support arm. In these figures, the front plate 1880 and the back plate 1890 fit over a vertically extending tom bracket arm in a tongue and groove manner in which the vertically oriented tom bracket arm slides upwards or downwards inside the vertical groove created front plate 1880 and the back plate 1890. It should be noted that the shape of the front plate 1880 and backplate 1890 casings and mounting hardware, shown in FIGS. 18-20, can be manufactured to mimic the shape of many of the bracket casings in which existing bracket casings of the prior art are manufactured. This allows the frontplate 1880 and the backplate 1890 as well as mounting hardware, listed herein, to be universally compatible with a variety of drum stands or drum racks, including horizontally extending bracket arms and other configurations A set of screws 1895 screw the back plate 1890 into the front plate 1880. The screws 1895 pass through openings about the back plate 1890 and screw into inner threaded holes about the outer face of the front plate 1880. It should be noted that the screws 1895 and bolts 1810, shown in FIGS. 18-20, can be manufactured to mimic a variety of mount-to-stand coupling orientations of the prior art. This allows universal compatibility of the mount-to-stand assembly elements to couple the enhanced drum mount to a variety of bracket arms, drum stands or drum racks.

A wing nut 1897 is further provided to fix the position of the mount-to-stand assembly on the tom bracket arm. The outer threads of the wing nut 1897 are screwed into inner threads located in the center of the back plate 1880 so that the wing nut 1897 tip comes into contact with the outer surface of the tom bracket arm inside the vertical groove. Contact between prevents further vertical, horizontal, or rotational movement of the drum when it is coupled to the tom bracket arm attached to a drum stand or drum rack.

Figure 20:
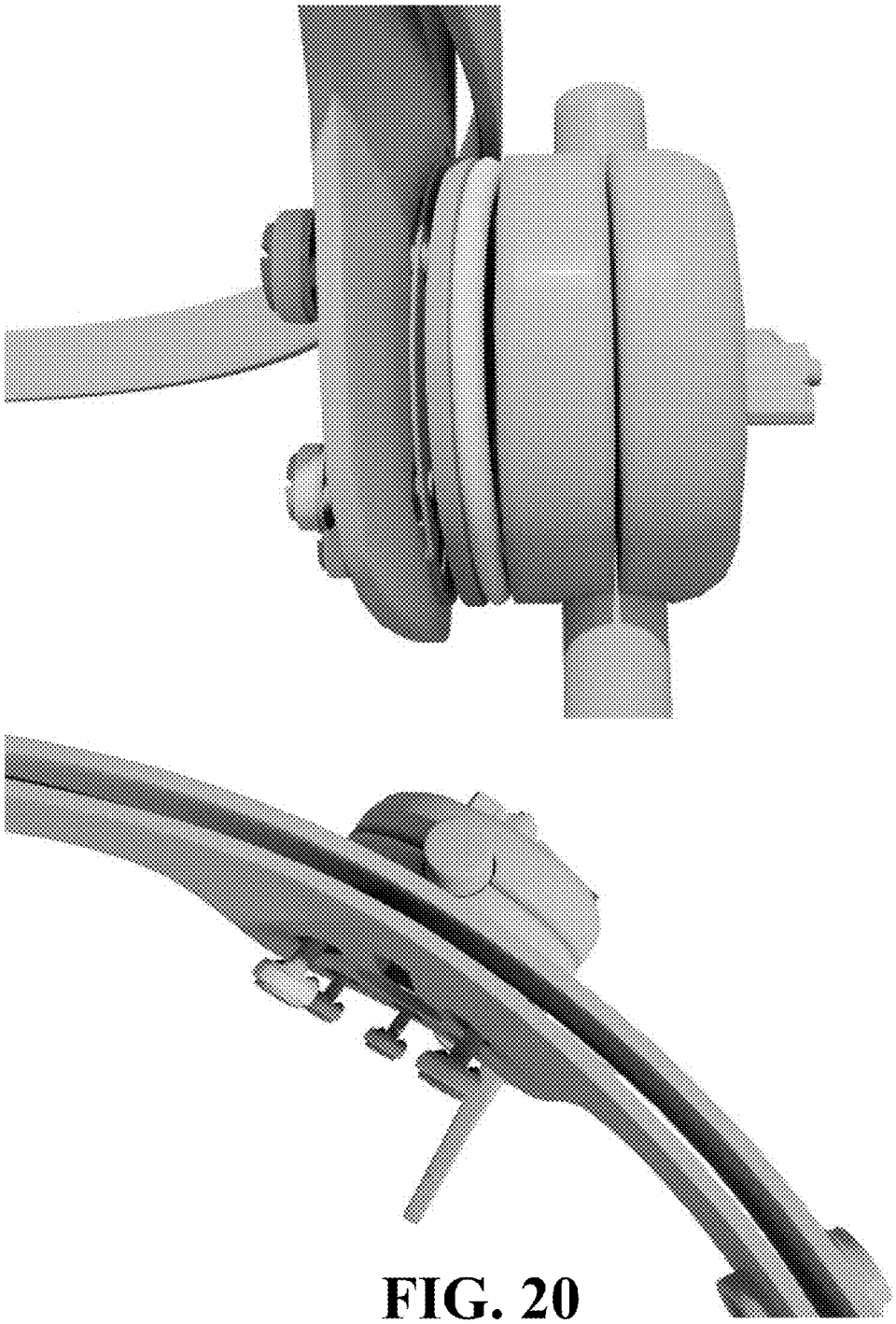
FIG. 20 provide two views for a completed mount-to-stand assembly in accordance with some embodiments.

FIG. 20 provide two views for a completed mount-to-stand assembly in accordance with some embodiments. As shown, the front plate 1880 and back plate 1890 surround the tom bracket arm with the wing nut 1897 securing their position about the support arm. The other components couple the inner mount plate vertical extension to the support arm with the multiple layers of dampening and isolation described above.

I claim:

1. A mounting assembly for mounting a drum to a supporting arm of a drum stand or drum rack with integrated vibration energy dampening, the mounting assembly comprising:

a front plate and a back plate with complimentary grooves in which the supporting arm is inset;

a set of screws coupling the back plate front side to the front plate back side;

an o-ring dampener disposed between the front plate front side and a back side of a mount bar coupled to the drum;

a plurality of dampeners disposed about a front side of the mount bar; and a plurality of bolts securing the plurality of dampeners and the o-ring dampener about either side of the mount bar by passing through the plurality of dampeners, apertures about the mount bar, and the o-ring dampener and screwing into the front plate front side.

2. The mounting assembly of claim 1 further comprising a gripped o-ring disposed between the o-ring dampener and the back side of the mount bar, wherein the gripped o-ring comprises a plurality of protrusions minimizing surface area contact between the gripped o-ring and the back side of the mount bar.

3. The mounting assembly of claim 2 further comprising a plurality of gripped endcaps disposed between the plurality of dampeners and the front side of the mount bar, each endcap of plurality of gripped endcaps comprising a plurality of protrusions minimizing surface area contact between the endcap and the front side of the mount bar.

4. The mounting assembly of claim 1, wherein each dampener of the plurality of dampeners comprises a central cavity through which a bolt of the plurality of bolts passes through.

5. The mounting assembly of claim 1 further comprising a wing nut screwing into a threaded aperture about the back plate, said wing nut securing a position of the back plate and the front plate about the supporting arm.

6. The mounting assembly of claim 1, wherein the front plate front side comprises a plurality of threaded apertures into which the plurality of bolts screw in.

7. The mounting assembly of claim 6, wherein the mount bar comprises a vertical extension with a hole pattern aligning with an orientation of the front plate front side plurality of threaded apertures.

8. A mount for coupling a drum to a drum stand or drum rack, the mount comprising:

a mount bar coupled to the drum, the mount bar comprising a vertical extension extending downwards about a side of the drum, the vertical extension comprising a plurality of apertures;

a set of dampeners disposed about either side of the vertical extension, the set of dampeners attenuating vibration energy transferred from the drum onto the mount bar during drum play;

a front bracket comprising a set of inner threaded apertures about a front side and a groove about a back side;

a back bracket comprising said groove about a front side and an inner threaded aperture about a back side extending through the back bracket to said groove;

a wing nut securing a position of a supporting arm of the drum stand or drum rack in between the groove of the front bracket and the back bracket by screwing into the inner threaded aperture about the back bracket back side; and a set of bolts with outer threading, the set of bolts securing the mount bar to the mount by passing through the set of dampeners and the plurality of apertures about the vertical extension and by screwing into the set of inner threaded apertures about the front bracket front side.

9. The mount of claim 8, wherein the front bracket further comprises a second set of inner threaded apertures about the back side, and wherein the back bracket further comprises a set of apertures extending through the back bracket and aligning with the second set of inner threaded apertures of the front bracket when the back bracket is aligned with the front bracket.

10. The mount of claim 9 further comprising a set of screws coupling the back bracket to the front bracket by passing through the back bracket set of apertures and by screwing into to the front bracket second set of inner threaded apertures.

11. The mount of claim 8, wherein said groove is vertically oriented for receiving a vertically extending drum stand or drum rack support arm.

12. The mount of claim 8, wherein said groove is horizontally oriented for receiving a horizontally extending drum stand or drum rack support arm.

13. The mount of claim 8, wherein the set of dampeners comprises at least two dampeners with a central cavity through which the set of bolts pass through.

14. The mount of claim 13, wherein the set of dampeners further comprises a circular ring with a circumference equal to the front bracket front side.

15. The mount of claim 14, wherein the at least two set of dampeners are disposed about a front side of the mount bar vertical extension and the circular ring is disposed about a back side of the mount bar.

16. The mount of claim 13 further comprising a set of gripped endcaps disposed between the set of dampeners and the mount bar vertical extension, each gripped endcap of the set of gripped endcaps comprising a plurality of protrusions reducing surface area contact between the set of dampeners and the mount bar vertical extension.

* * * * *